US005772308A

United States Patent [19]

Lin

[11] Patent Number: 5,772,308

[45] Date of Patent: Jun. 30, 1998

[54] LAMP CIRCUIT ASSEMBLY OF A SCREWDRIVER

[76] Inventor: Chang-Ming Lin, No. 331, Chang-Chun St., Chiu-Te Tsun, Wu-Jih Hsiang, Taichung County, Taiwan

[21] Appl. No.: 803,507

[22] Filed: Feb. 20, 1997

[51] Int. Cl.[6] ..... B25B 23/18

[52] U.S. Cl. ..... 362/119; 362/120; 362/206

[58] Field of Search ..... 362/119, 120, 362/206, 205, 204, 109

[56] References Cited

U.S. PATENT DOCUMENTS 4,283,757 8/1981 Nalbandian ..... 362/120
4,704,663 11/1987 Ohashi ..... 362/206
5,550,719 8/1996 Kuo ..... 362/120
5,628,556 5/1997 Hrabar et al. ..... 362/120

*Primary Examiner*—James C. Yeung
*Attorney, Agent, or Firm*—Harrison & Egbert

[57] ABSTRACT

A lamp circuit assembly mounted in a hollow handle of a screwdriver and partially projecting out of a hole of an end cap at one end of the handle and controlled to give light, including a LED mount having two opposite contacts, a plurality of light emitting diodes connected to the contacts of the LED mount, two battery cells reversely connected to the contacts of the LED mount, and a push button switch connected to the battery cells at one end opposite to the LED mount and pressed to turn on/off the LEDs.

1 Claim, 5 Drawing Sheets

LAMP CIRCUIT ASSEMBLY OF A SCREWDRIVER

TECHNICAL FIELD

The present invention relates to a screwdriver having a lamp circuit assembly, and more specifically to the lamp circuit assembly which easy to install, and can be positively operated.

BACKGROUND ART

Various screwdrivers with illuminator means have been disclosed, and have appeared on the market. FIG. 1A shows a screwdriver with a lamp circuit assembly according to the prior art. This structure of screwdriver comprises a hollow handle 10 defining a receiving chamber 101, two bulbs 12 bilaterally mounted in the receiving chamber 101 of the handle 10 at the front side, two metal springs 13 respectively mounted on the bulbs 12, two battery cells 14 respectively mounted on the metal springs 13 within the receiving chamber 101, a metal contact plate 16 mounted within the receiving chamber 101 and having a raised portion 160, two metal strips 15 respectively connected between the metal springs 13 and the metal contact plate 16, and a cap 11 threaded into the receiving chamber 101 and stopped at the raised portion 160 of the metal contact plate 16 against the battery cells 14. The lamp circuit assembly of this structure of screwdriver is not satisfactory in function. One drawback of this lamp circuit assembly is its complicated installation procedure. Another drawback of this lamp circuit assembly is that the metal contact plate tends to oscillate, thereby causing an on/off control error. Still another drawback of this lamp circuit assembly is its complicated operating procedure of switching on/off the circuit by turning the cap forwards or backwards. Furthermore, the bulbs consume much power and produce much heat when they are turned on.

FIG. 1B shows another structure of screwdriver with a lamp circuit assembly according to the prior art. This structure of screwdriver comprises a handle 20 defining a receiving chamber 21, a bulb 22 mounted in the receiving chamber 21 at the front side, two battery cells 23 connected in series to the bulb 22, a button 25, a spring 26 connected between the button 25 and the negative terminal of the rear battery cell 23, and a metal plate 24 connected between the bulb 22 and the button 25. The bulb 22 is switched on and off by controlling the button 25. The lamp circuit assembly of this structure of screwdriver is still not satisfactory in function. According to this design, it is difficult to positively position the metal plate and the button. If the lamp circuit assembly does not function well, it is difficult to detach the lamp circuit assembly for maintenance. Furthermore, the service life of the bulb is short because it consumes much power and produces much heat during its operation.

FIG. 1C shows still another structure of screwdriver with a lamp circuit assembly. This structure of screwdriver comprises a hollow handle 30, a coupling block 31 fastened to the handle 30 at the front side, a bulb 32 mounted in the coupling block 31, a battery cell 34 mounted in the handle 30 and disposed in contact with the positive terminal of the bulb 32, a button 36 mounted in a hole on the coupling block 31 at the front side, and two conductors 35 respectively connected between the negative terminal of the bulb 32 and the negative terminal of the battery cell 34 through the button 36. This structure of screwdriver is still not satisfactory in function. Because the battery cell and the conductors are sealed inside the handle and the coupling block, the assembly process of the screwdriver is complicated.

Furthermore, the service life of the bulb is short because it consumes much power and produces much heat during its operation.

SUMMARY OF THE INVENTION

The present invention provides a lamp circuit assembly for a screwdriver which eliminates the aforesaid drawbacks. It is one object of the present invention to provide a lamp circuit assembly for a screwdriver which is simple in structure. It is another object of the present invention to provide a lamp circuit assembly for a screwdriver which is easy to install. It is still another object of the present invention to provide a lamp circuit assembly for a screwdriver which can be positively operated. It is still another object of the present invention to provide a lamp circuit assembly for a screwdriver which consumes less power supply, and produces little heat during its operation. It is still another object of the present invention to provide a lamp circuit assembly which is durable in use. According to one aspect of the present invention, the lamp circuit assembly is mounted in a hollow handle of a screwdriver and partially projecting out of a hole of an end cap at one end of the handle The lamp circuit assembly is controlled so as to emit light. The lamp circuit assembly comprises a LED mount having two opposite contacts, a plurality of light emitting diodes connected to the contacts of the LED mount, two battery cells reversely connected to the contacts of the LED mount, and a push button switch connected to the battery cells at one end opposite to the LED mount and pressed to turn on/off the LEDs. According to another aspect of the present invention, the push button switch comprises a slotted locating plate, a push button partially projecting out the end cap and having two downward metal rods inserted through the slotted locating plate, and two metal springs respectively mounted on the metal rods of the push button and respectively stopped at the battery cells against the LED mount.

BRIEF DESCRIPTION OF THE DRAWINGS

FIG. 4A is sectional view of the present invention, showing the LEDs turned on.

DETAILED DESCRIPTION OF THE PREFERRED EMBODIMENT

Figure 1A:
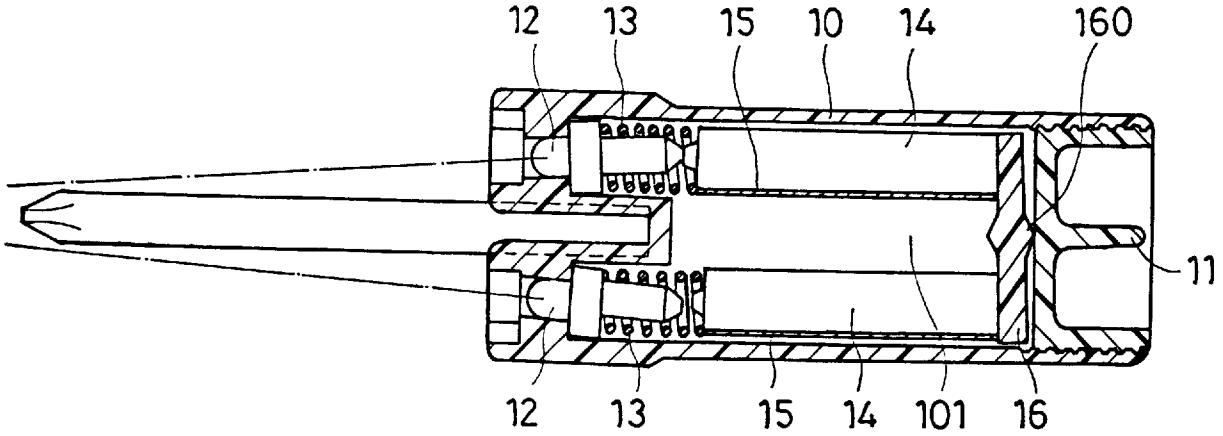
FIG.1A PRIOR ART
FIG. 1A is a sectional view of a screwdriver with a lamp circuit assembly according to the prior art.
Figure 1B:
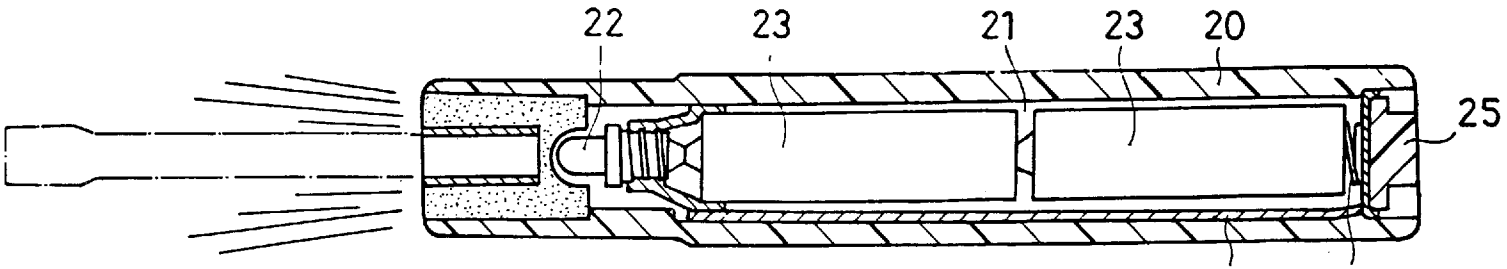
FIG.1B PRIOR ART
FIG. 1B is a sectional view of another structure of screwdriver with a lamp circuit assembly according to the prior art.
Figure 1C:
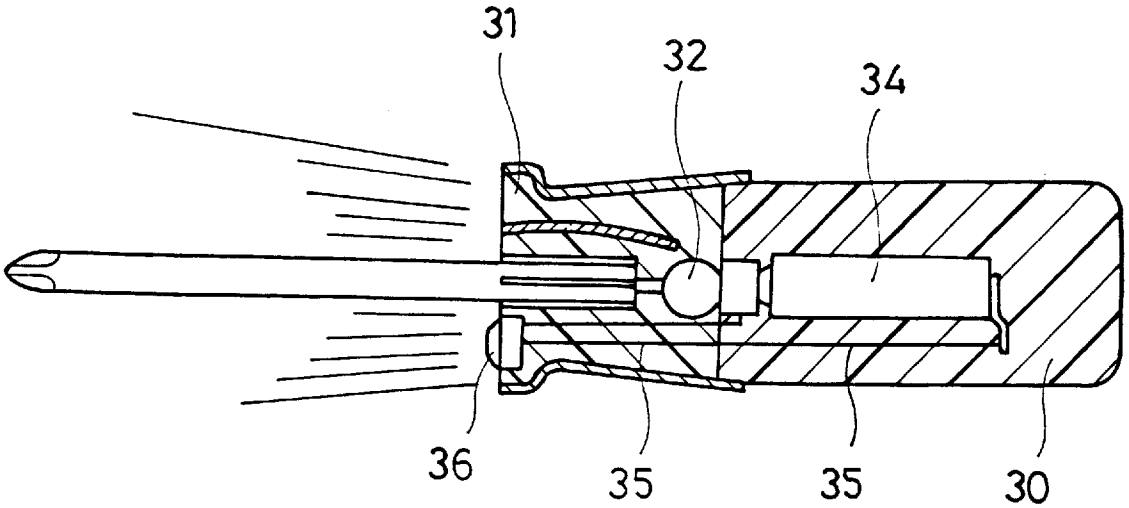
FIG.1C PRIOR ART
FIG. 1C is a sectional view of still another structure of screwdriver with a lamp circuit assembly according to the prior art.
Figures 2, 2A:
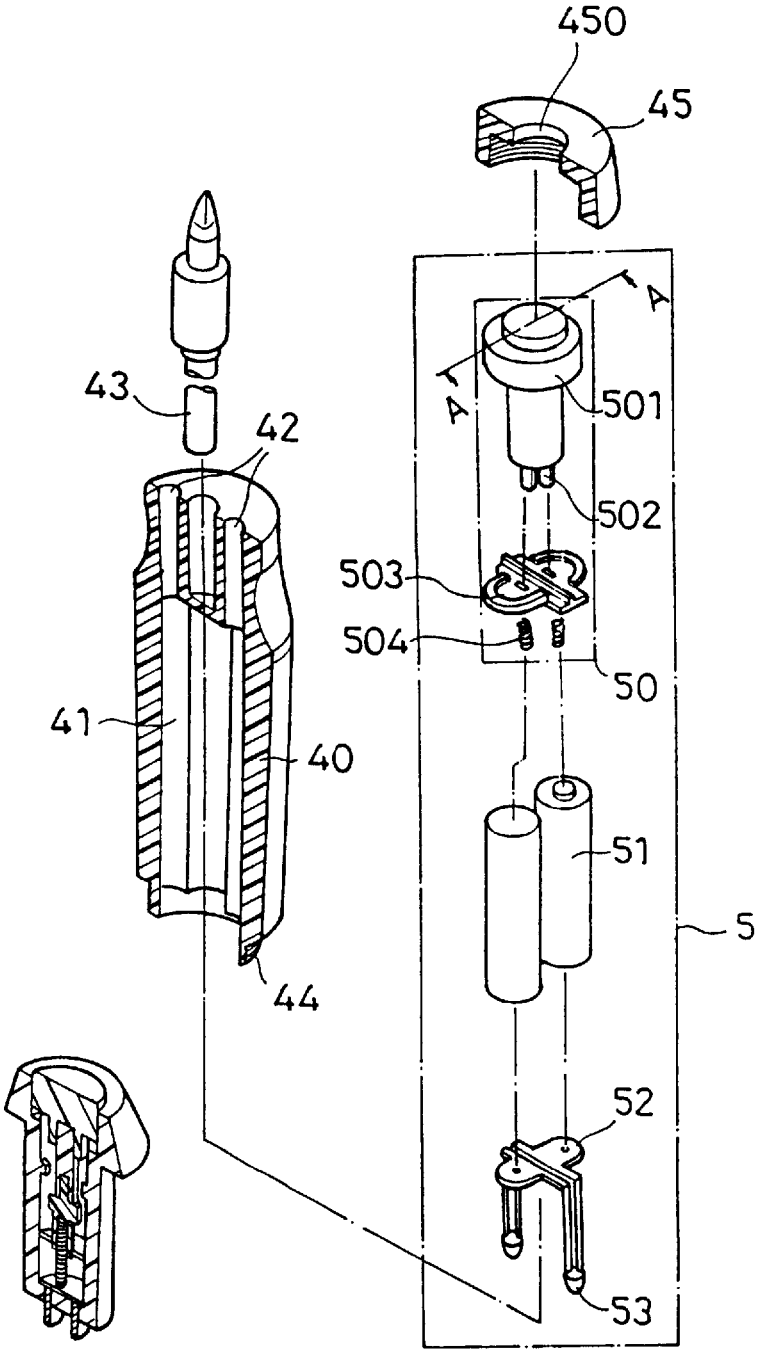
FIG. 2 is an exploded view of a screwdriver with a lamp circuit assembly according to the present invention.
FIG. 2A is a sectional view in an enlarged scale taken along line A—A of FIG. 2.
Figure 3:
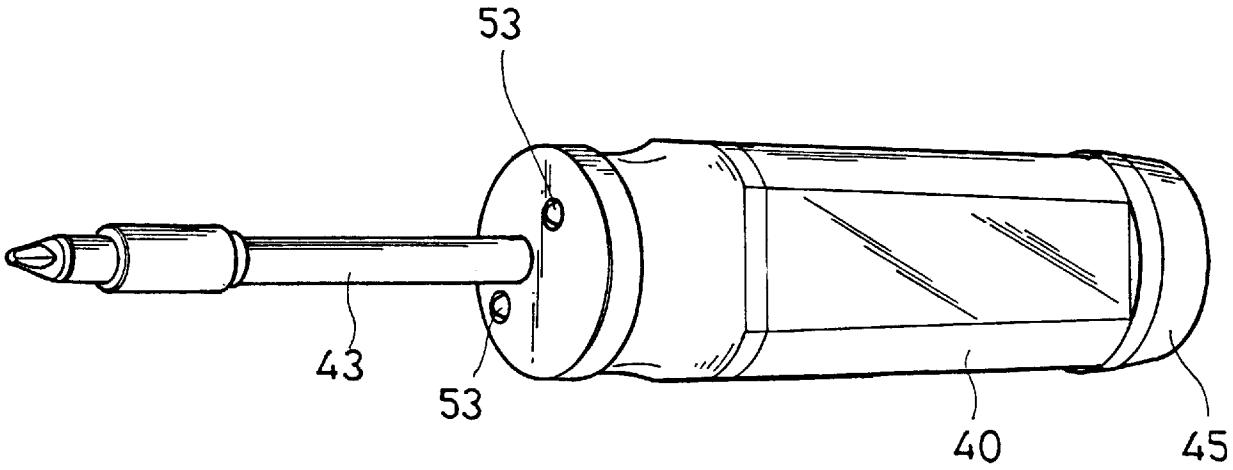
FIG. 3 is an elevational view of the screwdriver shown in FIG. 2.

Referring to FIGS. 2 and 3, a screwdriver is shown comprised of a handle 40, a blade 43, a lamp circuit assembly 5, and a screw cap 45. The blade 43 is fastened to one end, namely, the front end of the handle 40. The handle 40 comprises a longitudinal receiving chamber 41, two longitudinal lamp holes 42 extended from the receiving chamber 41 to the front end, and an outer thread 44 at the rear end. The lamp circuit assembly 5 is mounted in the receiving chamber 41 of the handle 40. The screw cap 45 is threaded onto the outer thread 44 of the handle 40. The lamp circuit assembly 5 comprises an LED mount 52, two LEDs (light emitting diodes) 53 connected to the LED mount 52, two battery cells 51 reversely connected to respective contacts at the LED mount 52, and a push button switch 50. The push button switch 50 comprises a slotted locating plate 503, a push button 501 partially projecting out of the center through hole 450 of the screw cap 45 and having two downward metal rods 502 inserted through the slotted locating plate 503, and two metal springs 504 respectively mounted on the metal rods 502 of the push button 501 and respectively stopped at the battery cells 51 against the LED mount 52. The LED mount 52, the battery cells 51 and the press button switch 50 form a loop. By means of pressing the push button switch 50, the LEDs 53 are turned on/off.

The installation procedure of the lamp circuit assembly 5 is outlined hereinafter with reference to FIGS. 2 and 4A. The LED mount 52 is mounted inside the receiving chamber 41, permitting the LEDs 53 to be respectively inserted into the lamp holes 42. The battery cells 51 are reversely mounted in the receiving chamber 41 and connected to the LED mount 52. The push button switch 50 is mounted in the receiving chamber 41, permitting the metal springs 504 to be respectively stopped at the positive and negative terminals of the battery cells 51. The screw cap 45 is threaded onto the outer thread 44 of the handle 40, permitting the push button 501 to project out of the center through hole 450 of the screw cap 45.

Figure 4A:
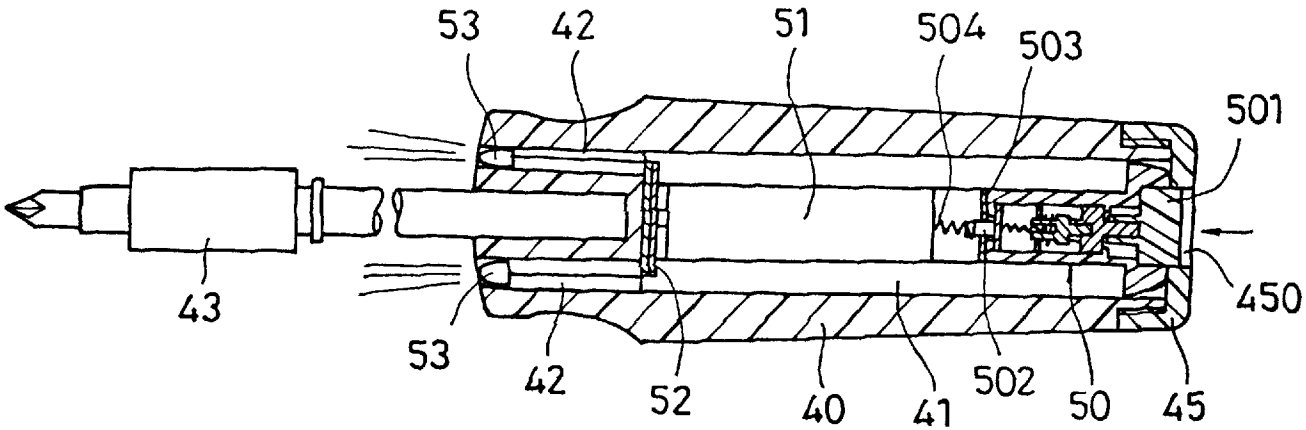
Figure 4B:
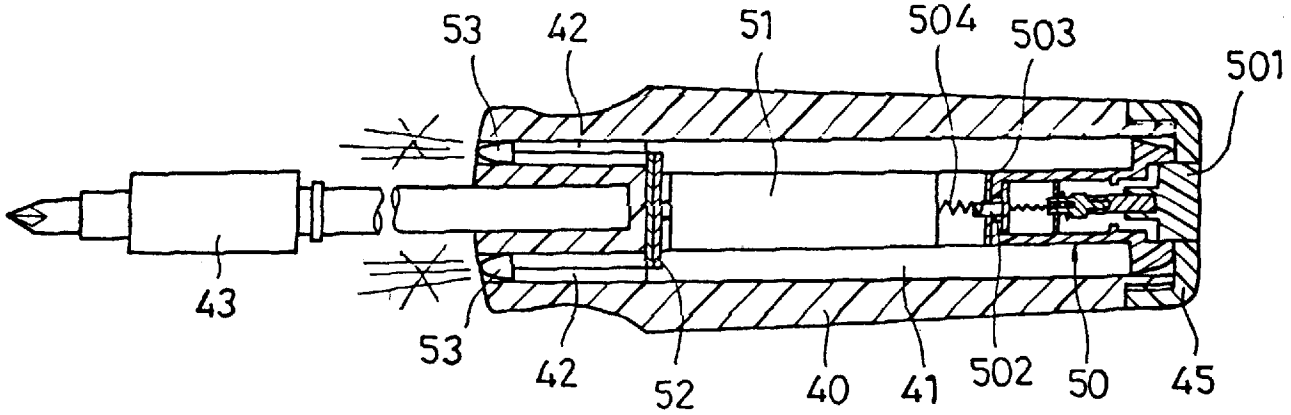
FIG. 4B is similar to FIG. 4A but showing the LEDs turned off.

When the screwdriver is used to turn a bolt or nut in a dark place, the press button switch 50 is pressed on to turn on the LEDs 53 (see FIG. 4A). After use, the press button switch 50 is depressed again to turn off the LEDs 53 (see FIG. 4B).

The foregoing disclosure and description of the invention is illustrative and explanatory thereof. Various changes in the details of the illustrated construction may be made within the scope of the appended claims without departing from the true spirit of the invention. The present invention should only be limited by the following claims and their legal equivalents.

I claim:

1. An apparatus comprising:

a screwdriver having a handle with a hollow interior, said handle having an end cap at one end thereof, said end cap having a hole formed therein, said screwdriver having lamp holes formed at an opposite end of said handle; and a lamp circuit means positioned within said hollow interior, said lamp circuit means for controllably emitting light therefrom, said lamp circuit means comprising:

a light emitting diode mount having two opposite contacts;

a plurality of light emitting diodes connected to said contacts of said light emitting mount, said plurality of light emitting diodes extending respectively into said lamp holes such that light is emitted outwardly of said hollow interior;

two battery cells reversely connected to said contacts of said light emitting diode mount; and a push button switch means connected to said battery cells at one end opposite to said light emitting diode mount, said rush button switch means being pressable for switching said light emitting diodes on and off, said push button switch means comprising:

a slotted locating plate;

a push button partially projecting out said hole in said end cap, said push button having two downward metal rods inserted through said slotted locating plate; and two metal springs respectively mounted on the metal rods of said push button, said metal springs respectively stopped at said battery cells against said light emitting diode mount.

* * * * *